United States Patent [19]

Kabakov et al.

[11] Patent Number: 4,769,921

[45] Date of Patent: Sep. 13, 1988

[54] PROCESS FOR RECUPERATING OF ORGANIC SOLVENTS IN DRY-CLEANING MACHINES

[75] Inventors: Vladimir M. Kabakov, Moscow; Ivan E. Razinkov, Gotvald Kharkovskoi, both of U.S.S.R.

[73] Assignee: Tsentralny Naucho-Issledovatelsky Institut Bytovogo Obsluzhivania Naselenia, Moscow, U.S.S.R.

[21] Appl. No.: 17,888

[22] Filed: Feb. 20, 1987

[30] Foreign Application Priority Data

Feb. 27, 1986 [SU] U.S.S.R. ..... 4026618

[51] Int. Cl.[4] ..... D06F 43/08

[52] U.S. Cl. ..... 34/27; 8/158; 34/32; 34/77; 68/18 C; 68/18 F

[58] Field of Search ..... 8/142, 158; 68/18 R, 68/18 C, 18 F; 34/27, 32, 77

[56] References Cited

U.S. PATENT DOCUMENTS

| | | | |
|---|---|---|---|
| 2,301,803 | 11/1942 | Davis | 68/18 B X |
| 2,656,696 | 10/1953 | McDonald | 68/18 R |
| 2,660,869 | 12/1953 | McDonald | 68/18 R |
| 3,538,615 | 11/1970 | Fuhring et al. | 68/18 F X |
| 3,557,581 | 1/1971 | Donini et al. | 68/18 F |

FOREIGN PATENT DOCUMENTS

| | | | |
|---|---|---|---|
| 1121014 | 1/1962 | Fed. Rep. of Germany | 68/18 R |

*Primary Examiner*—Philip R. Coe

*Attorney, Agent, or Firm*—Burgess, Ryan and Wayne

[57] ABSTRACT

A process for recuperation of organic solvents in dry-cleaning machines comprising circulation of air first through a cleaning drum of a machine containing textile articles treated with an organic solvent and squeezed, a filter, an air cooler and a heater, and then through a cleaning drum with the articles, filter, air cooler and an absorber. The circulated air recovers the solvent from the articles which solvent is first condensed in the air cooler and then adsorbed in the adsorber. Simultaneously with circulation of air through the cleaning drum, filter, air cooler and heater effected first is desorption of the solvent adsorbed in the previous process cycle of the dry-cleaning machine operation from the adsorbent by means of steam which together with vapors of the desorbed solvent is condensed in the heater, followed by the removal, from the adsorber to the heater, of the remaining steam and its condensate due to the pressure drop in the adsorber-heater system by means of compressed air. The air circulated through the cleaning drum, filter, air cooler and heater is heated by the heat evolved during condensation of the steam and vapors of the desorbed solvent.

1 Claim, 1 Drawing Sheet

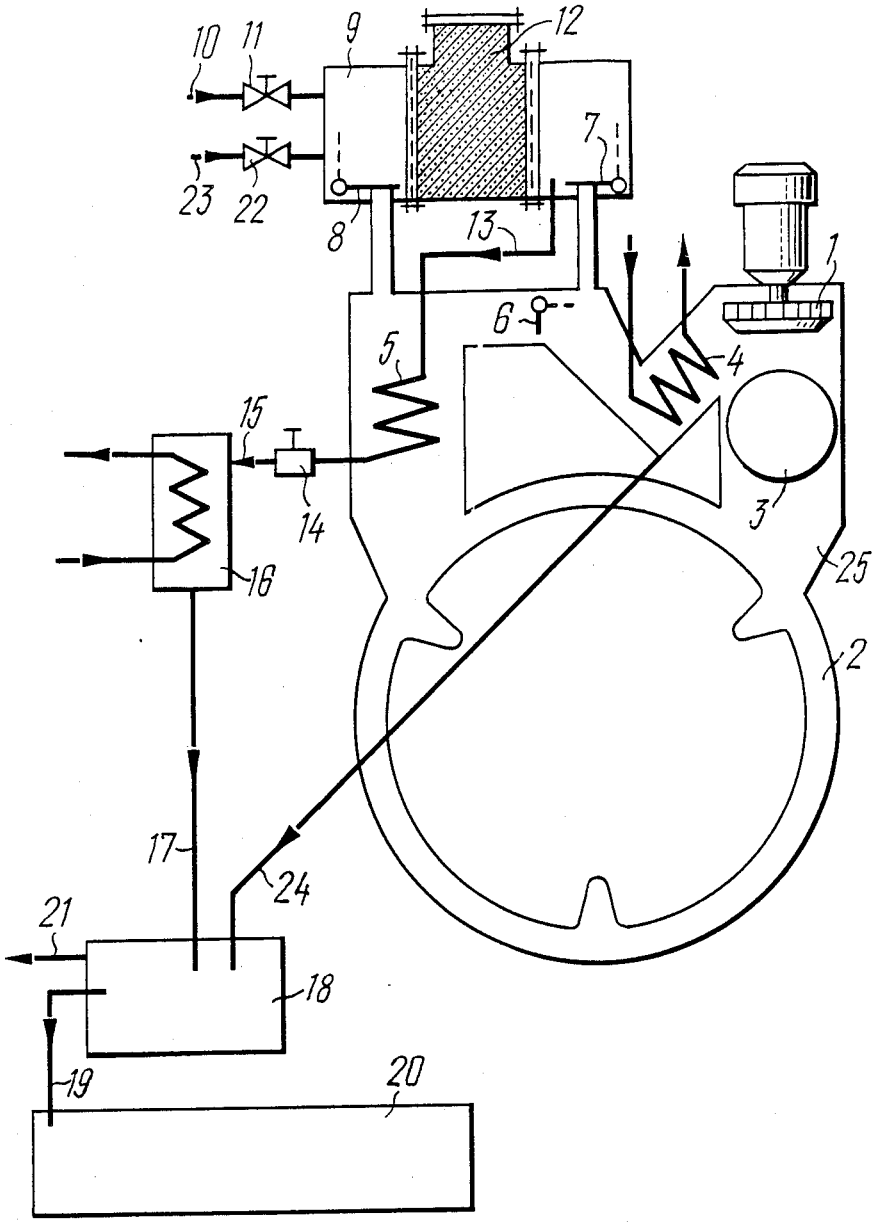
10
11
9
12
7
23
22
8
13
1
6
5
4
15
14
3
16
25
2
17
24
21
18
19
20

PROCESS FOR RECUPERATING OF ORGANIC SOLVENTS IN DRY-CLEANING MACHINES

FIELD OF THE INVENTION

The present invention relates to dry-cleaning of textile articles and, more specifically, to processes for recuperation of organic solvents in drying of textile articles treated with said solvents. Organic solvents perchlorethylene and trichlorethylene are most extensively used in dry cleaning of articles. However, these solvents are expensive and toxic compounds. For this reason, in drying of articles treated by these solvents their losses and exhausts into the atmosphere result in great economic outlay and environment pollution.

As a drying agent circulated air is used, by means of which the organic solvent is recovered from processed articles. The main requirements to be met in recuperation of organic solvents are the following: maximum entrapping, from the ciculated air, of the organic solvents recovered by air from the treated articles; elimination of the possibility of penetration of these solvents into the atmosphere; minimum rates of consumption of steam, cooling water and electric power; a high productivity of dry-cleaning machines; simple character of the employed equipment and maintenance fo dry-cleaning machinery; a high quality of drying of articles treated with organic solvents; i.e. a complete removal, from the articles, of organic solvents containing in them with retention of natural wetness of the articles (avoiding overdrying of them).

BACKGROUND OF THE INVENTION

Known in the art is a process for recuperation of organic solvents in dry-cleaning machines comprising circulation of air by means of a blower through a cleaning drum of a machine, containing articles treated with an organic solvent and squeezed, a filter, an air-cooler and a heater. The circulated air is heated in the heater, the organic solvent is recovered from the above-mentioned articles as a vapour by means of the circulated air, the heated circulated air containing vapours of the organic solvent is cleaned in a filter to remove mechanical foreign matter; the cleaned heated circulated air containing vapours of the organic solvent is cooled in an air cooler with condensation of vapours of the organic solvent. On completion of the formation of a condensate of the vapours of the organic solvent air is circulated by means of the above-mentioned blower through the above-mentioned cleaning drum, filter and air cooler, as well as an evaporator of the cooling machine. The circulated air is used to recover the organic solvent as a vapour from the treated articles; the circulated air containing vapours of the organic solvent is cleaned in a filter to remove mechanical foreign matter; the cleaned circulated air containing vapours of the organic solvent is cooled first in the air cooler and then in the cooling machine evaporator. The cooling surface of the evaporator has temperature of about −20° C. Owing to cooling of air in the cooling machine evaporator the organic solvent is condensed (U.S. Pat. No. 3,807,948).

A disadvantage of this prior art process for recuperation of organic solvents resides in an incomplete recovery thereof from the circulated air in the cooling machine evaporator. Thus, upon cooling of circulating air containing an organic solvent to a temperature of about −15° C. 17 g of perchlorethylene or 70 g of trichlorethylene remain in 1 $m^3$ of the air. This results, in turn, in losses of organic solvents which penetrate into the atmosphere upon discharging of treated articles from the cleaning drum and thus causes pollution of the environment.

Another disadvantage of this prior art process resides in high rates of electric power consumption in the case of using a cooling machine for condensation of an organic solvent from the circulated air.

Still another disadvantage of this process is a relatively low speed of condensation of the organic solvent in an evaporator of the cooling machine, this factor extending the recuperation process and lowering productivity of dry-cleaning machine.

A further disadvantage of this prior art process resides in that upon air circulation through the cleaning drum and cooling machine evaporator no natural wetness of the treated articles is retained due to recovery of not only the organic solvent from the treated articles but of water contained therein as well. There occurs over-drying of the articles, wherefore the quality of their cleaning is impaired. To restore the natural wetness of the articles, it is necessary to supply a corresponding amount of steam or atomized water into the cleaning drum, wherefore the operation of a dry-cleaning machine is made more complicated.

A still further disadvantage of the above-discussed process resides also in the necessity of using sophisticated and expensive cooling machinery for the maintenance of which a skillful operating personnel is required.

Also known in the art is a process for recuperation of organic solvents in dry-cleaning machines, comprising circulation of air by means of a blower through a cleaning drum of the machine, containing textile articles treated with an organic solvent and squeezed, a filter, an air cooler and a heater. The circulated air is heated in a heater, the organic solvent is recovered from said articles as a vapour by means of the heated circulated air; the heated circulated air containing vapours of the organic solvent is cleaned in a filter to remove mechanical foreign matter; the cleaned heated circulated air containing vapours of the organic solvent is cooled in an air cooler with condensation of the vapours of the organic solvent. On completion of the formation of a condensate of the vapours of the organic solvent air is circulated by means of the above-mentioned blower through said cleaning drum, filter and air-cooler, as well as an adsorber. The organic solvent is recovered from said articles as a vapour by means of the circulated air, the circulated air containing vapours of the organic solvent is cleaned in a filter from mechanical foreign matter, the cleaned circulated air containing vapours of the organic solvent is cooled in the air cooler and the organic solvent is adsorbed from the cooled cleaned circulated air in the adsorber. After several (about 20–30) process cycles of operation of the dry-cleaning machine (the term process cycle of the machine operation means operation of the machine from the moment of loading of dirty textile articles into the cleaning drum of the machine till the moment of discharging clean articles from the drum), each of them comprising circulation of air first through the cleaning drum, filter, air cooler and heater and then through the cleaning drum, filter, air cooler and adsorber, the adsorbed organic solvent is desorbed from the adsorbent by passing steam therethrough under a pressure of from 0.3 to 0.7 MPa. The steam passed through the adsorbent and vapours of the desorbed organic solvent are condensed in a condenser with water cooling to give a mixture of condensates which is cooled in the same condenser, whereafter the cooled mixture is separated into the organic solvent and water. On completion of desorption of the organic solvent steam is stopped to be passed through the adsorbent, and the steam and its condensate remaining after desorption are removed from the adsorber by means of heated air into the atmosphere (i.e. drying of the adsorbent is thus effected).

The desorption of the organic solvent from the adsorbent, condensation of the steam passed through the adsorbent and of vapours of the desorbed organic solvent, cooling of the resulting mixture of condensates, separation of the cooled mixture of condensates into the organic solvent and water and purging of heated air through the adsorber are effected for one hour while stopping air circulation (cf. Express information, CBSTI/Central Bureau of Scientific and Technological Information/, RSFSR Ministry of Household Servicing of Polulation, Series IV, Issue 3, 1980, June, Moscow; A. M. Epifanov, M. A. Kochetkov "Specific Features of the Design and Operation of the Dry-Cleaning Machine "Spetsima-212", pp. 14–19).

In this prior art process during the first several process cycles there occurs a substantially complete adsorption of the organic solvent from the circulated air. However, in the subsequent process cycles the degree of catching of organic solvents from the circulated air gradually diminishes due to saturation of the adsorbent with the organic solvent. This results in an increased amount of organic solvents remaining in the cleaning drum and in the articles contained therein and, hence, in increased losses of them and pollution of the environment. Furthermore, losses of the organic solvents and pollution of the environment therewith can occur during purging of the heated air through the adsorber for the removal of the steam and its condensate remaining therein, since a portion of the undesorbed organic solvent may be vented to the atmosphere together with the purging air.

Since after drying of the adsorbent a small amount of the steam condensate remains therein, in carrying out first process cycles upon air circulation through the adsorbent this condensate passes in atomized state into the cleaning drum, whereby natural wetness of the articles remaining in the cleaning drum is restored. Nevertheless, as the amount of the steam condensate in the adsorber gets lower in carrying out further process cycles of the machine operation, the admission of the steam condensate into the cleaning drum stops, whereby overdrying of articles takes place and, hence, their quality is impaired. It is, however, inadmissible to leave a high quantity of the steam condensate in the adsorbent after its drying, since this condensate passes into the cleaning drum in a non-atomized state in a great amount which may cause shrinkage of the articles.

Compared to the previously discussed prior art process, this process rules out the necessity of power consumption for condensation of organic solvents from the circulated air.

However, for carrying out of that process a considerable rate of steam consumption is necessary for heating the circulated air in the heater, desorption of the organic solvent and heating of the air used to remove the steam and its condensate remaining after desorption of the organic solvent from the adsorber, as well as a high rate of consumption of cooling water for condensation of the steam passed through the adsorbent and vapours of the desorbed organic solvent.

This process has another disadvantage residing in that upon admission of the steam supplied into the adsorber for description of the organic solvent a sharp reduction of the steam pressure occurs, which results in a lowering of its temperature and, hence, in a lesser efficiency of the desorption process.

This prior art process makes it possible to reduce duration of recuperation of organic solvents as compared to that discussed hereinbefore. However, for its carrying out additional time is required for desorption of the organic solvent from the adsorbent, condensation of the steam passed through the adsorbent and of vapours of the desorbed organic solvent, cooling of the resulting mixture of condensates, separation thereof into the organic solvent and water and the removal of the steam and its condensate remaining in the adsorber after the desorption of the organic solvent (drying of the adsorbent), since in performing these operations the air circulation is stopped, i.e. the operation of the dry-cleaning machine is discontinued. Such periodic shutdowns result in a lowered productivity of the machine.

This process does not require, as compared to the previously discussed one, qualified operating personnel for the maintenance of the coiling machinery; however, in this process maintenance of the dry-cleaning machine is more complicated owing to the necessity of periodic shutdowns of the machine for carrying out the above-mentioned operations.

In the case of using two alternatingly operating adsorbers the design of the dry-cleaning machine is substantially complicated, while its maintenance is not simplified.

Also known in the art is a process for removing steam, its condensate and the organic solvent remaining after the desorption of the organic solvent during its recuperation from the adsorber, wherein the steam, its condensate and a portion of the non-desorbed organic solvent in the vaporous state are removed by means of heated air into a water-cooled condenser, followed by cooling of the resulting mixture of the condensates and its separation into water and the organic solvent (U.S. Pat. No. 4,440,549).

This prior art process has a disadvantage residing in the necessity of consumption of cooling water for condensation of steam and vapours of the non-desorbed organic solvent, as well as in losses of heat evolved in this condensation.

SUMMARY OF THE INVENTION

It is an object of the present invention to provide an effective process for recuperation of organic solvents in dry-cleaning machines which would make it possible to substantially reduce losses of organic solvents.

It is another object of the present invention to provide a process for recuperation of organic solvents in dry-cleaning machines which would make it possible to prevent pollution of the environment with said solvents.

It is still another object of the present invention to provide a process which would enable a lesser consumption of steam and cooling water at a relatively low rate of electric power consumption.

It is a further object of the present invention to increase the productivity of a dry-cleaning machine and simplify its maintenance.

Still further object of the present invention is to improve the quality of drying of the articles treated with organic solvents.

These and other objects of the present invention are accomplished by the provision of a process for recuperation of organic solvents in dry-cleaning machines, comprising air circulation by means of a blower through a cleaning drum of a machine, containing textile articles treated with an organic solvent and squeezed, a filter, an air cooler and a heater; the circulated air is heated in a heater, the organic solvent is recovered by the heated circulated air from the treated articles as a vapour; the heated circulated air containing vapours of the organic solvent is cleaned in the filter from mechanical foreign matter; the cleaned heated circulated air containing vapours of the organic solvent is cooled in the air cooler to condense vapours of the organic solvent; on completion of the formation of a condensate of vapours of the organic solvent circulation of air is effected by means of said blower through said cleaning drum, filter and air cooler, as well as an adsorber; the organic solvent is recovered from said articles by means of the circulated air as a vapour; the circulated air containing vapours of the organic solvent is cleaned in the filter from mechanical foreign matter; the cleaned circulated air containing vapours of the organic solvent is cooled in the air cooler and the organic solvent is adsorbed from the cleaned cooled circulated air in the adsorber; the adsorbed organic solvent is desorbed from the adsorbent by passing steam therethrough under a pressure of from 0.3 to 0.7 MPa; the steam passed through the adsorbent and vapours of the desorbed organic solvent are condensed; the resulting mixture of condensates is cooled and separated into the organic solvent and water; on completion of desorption of the organic solvent passing of the steam through the sorbent is stopped; the steam and its condensate remaining after desorption of the organic solvent are removed from the adsorber using air and the steam removed from the adsorber is condensed; in doing so, according to the present invention, simultaneously with air circulation through the cleaning drum, filter, air cooler and heater first effected is desorption of the organic solvent from the adsorbent and then—the removal of steam and its condensate remaining after desorption of the organic solvent from the adsorber; condensation of the steam passed through the adsorbent and of vapours of the desorbed organic solvent is effected in said heater simultaneously with heating of the circulated air by means of the heat evolved upon condensation; the mixture of condensates obtained in the heater is fed to cooling through a condensate-removing duct; the removal of the steam and its condensate remaining after the desorption of the organic solvent from the adsorber is effected by displacing them into said heater, wherein condensation of steam is effected simultaneously with heating of the circulated air by means of the heat evolved during condensation; said displacement is effected first due to a pressure drop in the adsorber-heater system, owing to a reduction of pressure in the heater upon condensation of steam and then—after reaching a pressure of steam in the adsorber of 0.05–0.3 MPa, by means of air supplied to the adsorber under a pressure of from 0.3 to 0.6 MPa.

Owing to the fact that the steam fed into the adsorber under a pressure of 0.3 to 0.7 MPa and passed through the adsorbent passes together with vapours of the desorbed solvent to condensation into the heater, wherefrom the resulting mixture of condensates is delivered to cooling through a condensate-removing duct, the amount of steam fed into the adsorber, its supply rate, the value and distribution of pressure in the adsorber-heater system are dependent on the intensity of condensation of the steam and vapours of the desorbed organic solvent which intensity, in turn, depends on the amount of heat consumed for heating of the circulated air during drying of the textile articles contained in the cleaning drum.

As has been shown by appropriate studies, the amount of steam admitted into the adsorber substantially corresponds to its consumption for heating of the circulated air during drying of the articles, since the heat energy consumed in the adsorber for desorption of the solvent is mainly compensated by the heat energy evolved in the heater during condensation of the desorbed solvent. Owing thereto, conditions are created (pressure, temperature and rate of supply of the steam, pressure drop in the system adsorber-heater) that ensure an effective desorption of the organic solvent from the adsorbent and a substantially complete removal of the desorbed solvent into the heater.

After discontinuation of the stream supply into the adsorber in connection with the ongoing air circulation through the cleaning drum, filter, air-cooler and heater, as well as owing to condensation of the steam remaining in the heater, the pressure drop in the system adsorber-heater is retained for some time (2 to 5 minutes). Owing to this fact the steam and its condensate remaining in the adsorber after desorption of the organic solvent are displaced into the heater. At the final stage of this process (when pressure in the adsorber reaches 0.05–0.3 MPa) its efficiency is improved and its duration is shortened owing to the supply of air into the adsorber under a pressure of 0.3 to 0.6 MPa. Such conditions of the removal of steam and its condensate from the adsorber make it possible to avoid consumption of steam for heating air, employed in the prior art process for the removal of residual amounts of steam and its condensate from the adsorber and to substantially reduce the duration of this operation.

Owing to the fact that desorption of the organic solvent from the adsorbent and removal of the remaining steam and its condensate are effected at a higher efficiency in each process cycle of the dry-cleaning machine operation, a substantially full removal of organic solvents from the cleaning drum and the articles contained therein is ensured which, in turn, results in lower losses of organic solvents and prevents pollution of the environment therewith during the unloading of the processed articles from said cleaning drum.

Furthermore, reduced losses of the organic solvents and prevention of pollution of the environment therewith are accomplished owing to the elimination of discharging a portion of the non-desorbed solvent with the heated air into the atmosphere upon the removal of the remaining steam and its condensate from the adsorber.

A substantially complete removal of organic solvents from the cleaning drum improves the quality of drying of the articles. At the same time, after every process cycle of the dry-cleaning machine operation a small amount of the steam condensate remains in the adsorbent, which condensate passes into the cleaning drum in an atomized state upon air circulation in the following process cycle, thus precluding the possibility of overdrying of the articles.

The desorption of the organic solvent and removal of the steam and its condensate remaining after desorption of the organic solvent under the above-described conditions makes it possible to shorten the duration of the above-mentioned processes which, in turn, enables desorption of the organic solvent and removal of the remaining steam and its condensate simultaneously with the air circulation through the cleaning drum, filter, air cooler and heater. This results in an improved productivity of a dry-cleaning machine, since no additional time is required for desorption of the organic so vent from the adsorbent and for the removal of the remaining steam and the condensate thereof from the adsorber, whereas these operations in the prior art process are carried out when the dry-cleaning machine is shutdown.

The dry-cleaning machine maintenance is also simplified, since desorption of the organic solvent from the adsorbent and the removal of the remaining steam and its condensate from the adsorber are effected automatically without participation of the operator.

Owing to the fact that for heating of the circulated air the heat is used which is evolved upon condensation of the steam passed through the adsorbent and of vapours of the desorbed organic solvent, as well as the heat evolved upon condensation of the steam removed from the adsorber after desorption of the organic solvent, the total rate of consumption of steam for desorption of the organic solvent and heating of the circulated air in the heater for drying of the articles contained in the cleaning drum is reduced.

Since the steam passed through the adsorbent and vapours of the desorbed solvent are condensed in the heater as a result of cooling thereof with the circulated air, it is possible to eliminate consumption of cooling water for these purpose.

Another advantage of the process according to the present invention resides in a simple process equipment employed owing to a considerable reduction of the size of the adsorber which is designed for adsorption of the organic solvent from the circulated air over one process cycle.

As has been mentioned hereinbefore, during desorption of organic solvents steam is admitted into the adsorber under a pressure of 0.3 to 0.7 MPa. It is inadvisable to use steam under a pressure of less than 0.3 MPa for this purpose, since upon its condensation in the heater heating of the circulated air to the temperature required for drying the textile articles contained in the cleaning drum of the machine is not ensured. It is neither advisable to use steam under a pressure of more than 0.7 MPa due to the risk of decomposition of some types of organic solvents employed for dry cleaning of textiles at a high temperature.

Experiments have shown that for displacement of the steam and its condensate remaining after desorption of the organic solvent from the adsorber into the heater, the pressure of air supplied to the adsorber should be not less than 0.3 MPa, since at a smaller pressure a considerable amount of the steam condensate remains in the adsorber. The efficiency and rate of displacement of the steam and its condensate are increased with increasing pressure of the air supplied to the adsorber to 0.6 MPa. This value is identical to the pressure of compressed air employed in modern dry-cleaning machine for pneumatic drive of various actuators of the machines.

At the moment of air admission the steam pressure in the adsorber should be less than the pressure of air supplied. Experiments have shown that the air supply should be started is the steam pressure in the adsorber does not exceed 0.05–0.3 MPa. In this case the pressure of air fed into the adsorber should exceed the steam pressure in the adsorber by 0.25–0.3 MPa.

BRIEF DESCRIPTION OF THE DRAWING

The process for recuperation of organic solvents in dry-cleaning machines according to the present invention will now be more fully described with reference to the flow-sheet illustrating the process according to the invention and shown in the accompanying drawing.

DETAILED DESCRIPTION OF THE INVENTION

As shown in the Figure, air circulation is effected by means of a blower 1 through a cleaning drum 2, filter 3, air cooling 4 and heater 5. The shutter 6 is opened (shown by a dotted line), valves 7 and 8 are closed. In the above-mentioned cleaning drum 2 textile articles are charged such as clothes from wool, cotton and synthetic fabrics, suede, fur, drapery, carpet goods, treated by an organic solvent such as perchlorethylene or trichlorethylene and squeezed, for example by centrifugation.

Simultaneously with the circulation desorption of the organic solvent from the adsorber 9 adsorbed in the previous process cycle of the machine operation is first effected, followed by displacement, from the adsorber 9 into the heater 5, of the steam and its condensate remaining after desorption of the organic solvent.

For desorption of the organic solvent adsorbed in the previous process cycle of operation of the dry-cleaning machine the steam is admitted under a pressure of 0.3–0.7 MPa via the line 10 through the valve 11 into the adsorber 9 and passed through the adsorbent 12 which comprises, as a rule, activated charcoal. The steam passed through the adsorbent and vapours of the desorbed organic solvent are delivered via the line 13 into the heater 5, wherein condensation of these vapours occurs as a result of the heat-exchange between the vapours and the circulated air. The mixture of condensates produced in the heater is fed through the condensate-removing duct 14 via the line 15 to cooling in the water-cooled heat-exchanger 16 and therefrom—via the line 17 to the water separator 18 for separation of the cooled mixture of condensates into the organic layer and water. From the water separator 18 the organic solvent is delivered via the line 19 to the tank 20 for a repeated use for dry cleaning of articles. The separated water is removed from the separator 18 to sewarage via the line 21.

The heat evolved during condensation of the steam and vapours of the desorbed organic solvent is used for heating of the circulated air in the heater 5 to the temperature necessary for drying of articles of the appropriate assortment.

On completion of desorption of the organic solvent the valve 11 in the line 10 is closed and passage of steam through the adsorbent 12 is stopped. Owing to the continued circulation of air through the cleaning drum 2, filter 3, air cooler 4 and heater 5 and to condensation of the steam remaining in the heater 5, the pressure drop in the system adsorber-heater is retained for some time (2 to 5 minutes). As a result, the steam and its condensate remaining in the adsorber 9 after desorption of the organic solvent are displaced from the adsorber 9 into the heater 5. On achieving a pressure value of 0.05–0.3 MPa in the adsorber 9, the valve 22 in the line 23 is opened and air under a pressure of 0.3–0.6 MPa is fed into the adsorber 9 by means of a compressor or a blower. The supply of air into the adsorber 9 contributes to its higher efficiency and to a shorter duration of displacement of the remaining steam and its condensate from the adsorber 9 to the heater 5. The steam removed from the adsorber 9 is condensed in the heater 5 with heating of the circulated air by means of the heat evolved during condensation.

The heated circulated air is used for the recovery of the organic solvent as a vapour from the above-mentioned articles, whereafter the heated circulated air containing vapours of the organic solvent is cleaned in the filter 3 from mechanical foreign matter. Then the cleaned heated circulated air containing vapours of the organic solvent is cooled in the air cooler 4 with condensation of vapours of the organic solvent. The condensate should be preferably removed into the above-mentioned water separator 18 via the line 24 for the separation, form the organic solvent, of water penetrated thereinto during the drying of the treat articles. From the water separator 18 the organic solvent is delivered to the tank 20 for a repeated use in dry cleaning of articles.

As the textiles get dried, the content of the organic solvent in the circulated air upon its discharge from the cleaning drum 2 is lowered and, hence, the content of the organic solvent condensed in the air cooler 4 is decreased too.

On completion of the formation of the condensate of vapours of the organic solvent in the air cooler 4 (the term completion of the condensate formation means diminution of the intensity of condensation in the air cooler 4 to such an extent that a further circulation of air under the above-described conditions becomes economically inexpedient) the air supply into the adsorber 9 is stopped by closing the valve 22 in the line 23, whereafter air circulation is effected by means of the blower 1 through the cleaning drum 2, filter 3, air cooler 4 an adsorber 9. In doing so, the shutter 6, valves 11 and 22 are closed, while the valves 7 and 8 are opened (shown in dotted line). The circulated air is used to recover the organic solvent as a vapour from the textile articles, the circulated air containing vapours of the organic solvent is cleaned in the filter 3 from mechanical foreign matter; the cleaned circulated air containing vapours of the organic solvent is cooled in the air cooler 4 and the organic solvent is adsorbed from the cooled cleaned circulated air in the adsorber 9. The circulated air passing through the adsorber 9 is heated by means of the heat of adsorption liberated during adsorption of the organic solvent, as well as by means of the heat accumulated in the adsorbent 12 and in the parts of the adsorber 9 heated during desorption of the organic solvent.

The circulated air from the adsorber 9 can pass in two ways into the cleaning drum 2, either directly into this drum or, as shown in the diagram, through the heater 5, in the latter case no heating steam is fed into the heater.

The circulated air, while passing through the adsorber 9, is moistened at the account of the steam condensate incompletely removed from the adsorbent 12. This moisture in the atomized state passes together with the circulated air into the cleaning drum 2, whereby the possiblity of overdrying of the textiles contained in said drum is prevented. Since the circulated air passing from the adsorber 9 into the cleaning drum 2 contains no organic solvent, it ensures a substantially complete recovery of the organic solvent from the articles contained in the cleaning drum and from the air filling the cleaning drum 2 and casing 25 of the drying-recuperation unit composed of the filter 3, blower 1, air cooler 4 and heater 5.

On expiration of the time necessary for a substantially complete removal of the organic solvent from the articles of a given assortment and for their cooling, the air circulation through the cleaning drum 2, filter 3, air cooler 4 and adsorber 9 is discontined. The dried articles are discharged from the cleaning drum 2. The ready articles contain no organic solvent, have a natural wetness and a relatively low temperature.

For a better understanding of the present invention some specific examples illustrating its particular embodiments are given hereinbelow.

EXAMPLE 1

Recuperation of perchlorethylene employed for the treatment of textile woolen articles (costumes, dresses, overcoats, jackets and the like) with the mass of 9 kg by the procedure suitable for this kind of articles, followed by squeezing by centrifugation, is carried out. The content of perchlorethylene in the treated and squeezed textile articles is 38% by mass, i.e. 3.4 kg.

To carry out recuperation of perchlorethylene, air is circulated by means of a blower 1 through a cleaning drum 2 containing said articles, filter 3, air cooler 4 and a heater 5. A shutter 6 in this case is opened (shown in dotted line), valves 7 and 8 are closed. The duration of this circulation of air is 11 minutes.

Simultaneously with this circulation of air desorption of perchlorethylene adsorbed in the previous process cycle of operation of the dry-cleaning machine from the adsorber 9 is effected for 8 minutes, followed by displacement of the steam and its condensate remaining after desorption of perchlorethylene from the adsorber 9 into the heater 5 for 3 minutes.

To carry out desorption of perchlorethylene adsorbed in the previous process cycle of the dry-cleaning machine operation steam is fed under the pressure of 0.6 MPa via the line 10 through the valve 11 into the adsorber 9 and passed through the adsorbent 12.

As the adsorbent use is made of recuperated activated carbon with the granule size of 3 mm with the static adsorptivity of 0.29 kg of the solvent per kg of the carbon. The adsorbent mass is 4 kg.

The steam passed through the adsorbent and vapours of desorbed perchlorethylene are delivered via the line 13 to the heater 5, wherein as a result of heat transfer between these vapours and the circulated air these vapours are condensed. The mixture of condensates obtained in the heater is delivered to cooling through the condensate-removing duct 14 via the line 15 into a water-cooled heat-exchanger 16 and, therefrom, via the line 17 into the water separator 18 for separation of the cooled mixture of condensates into perchlorethylene and water. From the water separator 18 perchlorethylene is fed via the line 19 into the tank 20 for a repeated use in dry cleaning. Water is removed from the water separator 18 to sewerage via the line 21.

Owing to the heat evolved in condensation of steam and vapours of desorbed perchlorethylene the circulated air is heated in the heater 5 to the temperature of 90° C.

On completion of desorption of perchlorethylene the valve 11 is closed in the line 10 and admission of steam through the adsorbent 12 is stopped. Owing to continuation of the air circulation through the cleaning drum 2, filter 3, air cooler 4 and heater 5 condensation of the steam remaining in the heater 5 occurs and the pressure drop in the system adsorber-heater is retained. As a result, the steam and its condensate remaining in the adsorber 9 after desorption of perchlorethylene are displaced from the adsorber 9 into the heater 5. Upon reduction of the steam pressure in the adsorber 9 to 0.03 MPa the valve 22 in the line 23 is opened and air under the pressure of 0.6 MPa is admitted into the adsorber 9. The steam withdrawn from the adsorber 9 is condensed in the heater 5 with heating of the circulated air by means of the heat evolved during this condensation.

Perchlorethylene is recovered as a vapour from the treated articles by means of the heated circulated air. The air temperature is lowered. At the beginning of the process of drying of the articles the circulated air at the outlet of the cleaning drum has temperature of 50° C. at which it contains 520 g/m$^3$ of perchlorethylene.

The heated circulated air containing vapours of perchlorethylene is cleaned in the filter 3 from mechanical foreign matter, then cooled in the air cooler 4 to the temperautre of 25° C. at which the content of perchloethylene in the air is 175 g/m$^3$. The excessive amount of perchlorethylene contained in the heated circulated air being fed into the air cooler 4 is condensed in the latter. The condensate is withdrawn via the line 24 into the water separator 18 to separate, from perchlorethylene, water penetrated thereinto during drying of the articles. From the water separator 18 perchlorethylene is delivered to the tank 20 for a repeated use in dry cleaning. Water from the water separator 18 is drained into sewerage via the line 21.

As the textile articles get dried, the content of perchlorethylene in the circulated air leaving the cleaning drum is lowered. After reaching the content of perchlorethylene in the circulated air at the outlet of the cleaning drum 2 equal to its content (175 g/m$^3$) in the circulated air after air cooling in the air cooler 4, the formation of a condensate of perchlorethylene in the air cooler is substantially stopped (the term discontinuation of the formation of the condensate means diminution of the intensity of condensation in the air cooler 4 to such an extent that a further circulation of air under the above-described conditions becomes economically inexpedient). At this moment the content of perchlorethylene in the textile articles is equal to 3% by mass, i.e. 270 g. The total amount of perchlorethylene contained in the textile articles and in the circulated air filling the cleaning drum 2 and casing 25 of the drying-recuperation unit consisting of the filter 3, blower 1, air cooler 4 and heater 5 is equal to 415 g.

On discontinuation of the formation of a condensate of perchlorethylene vapours in the air cooler 4 the air admission into the adsorber 9 is stopped by closing the valve 22 in the line 23, whereafter air circulation is effected by means of the blower 1 through the cleaning drum 2, filter 3, air cooler 4 and adsorber 9. In this case the shutter 6, valves 11 and 22 are closed, while valves 7 and 8 are opened (shown in dotted line). The duration of this circulation of air is 4 minutes.

Perchlorethylene as a vapour is recovered from the textile articles by means of the circulated air; the circulated air containing vapours of perchlorethylene is cleaned in the filter 3 from mechanical foreign matter; the cleaned circulated air containing vapours of perchlorethylene is cooled in the air cooler 4 and perchlorethylene is adsorbed from the cleaned circulated air in the adsorber 9.

The circulated air passing through the adsorber 9 is heated by the heat of adsorption evolved during adsorption of perchlorethylene, as well as by means of the heat accumulated in the adsorbent 12 and parts of the adsorber 9 heated during desorption of perchlorethylene.

The circulated air from the adsorber 9 is passed into the cleaning drum 2, as shown in the diagram, via the heater 5, in this case no heating steam is fed into the heater 5.

The circulated air passing through the adsorber 9 is moistened at the account of the steam condensate incompletely removed from the adsorbent 12. This moisture is fed in the atomized state with the circulated air into the cleaning drum 2 thus avoiding the possibilty of overheating the textile articles contained in the cleaning drum.

Since the circulated air fed from the adsorber 9 into the cleaning drum 2 contains no perchlorethylene, it ensures a substantially complete recovery of perchlorethylene contained both in the textile articles and in the air filling the cleaning drum 2 and the casing 25 of the drying-recuperation unit.

During the above-specified time (4 minutes) of the air circulation through the cleaning drum 2, filter 3, air cooler 4 and adsorber 9 there occurs a substantially complete removal of perchlorethylene from the articles of a given assortment and their cooling as well. On expiration of the above-specified time the air circulation through the cleaning drum 2, filter 3, air cooler 4 and adsorber 9 is stopped. The dried articles are discharged from the cleaning drum 2.

The total duration of the process of recuperation of perchlorethylene is 15 minutes.

As a result, a high quality of drying of the textile articles is ensured (a substantially complete removal of perchlorethylene therefrom with retention of their natural wetness), losses of perchlorethylene are considerably reduced, the environment pollution with perchlorethylene is avoided. During recuperation of perchlorethylene by the process according to the present invention the losses of this solvent are 3 g per kg of the articles (mainly due to an incomplete separation of water from perchlorethylene in the setting-type water separator). For drying of 1 kg of textile articles with a substantially full recuperation of perchlorethylene 0.7 kg of steam and 10 l of cooling water are consumed, the rate of electric energy consumption is 0.06 kW.h.

In recuperation of perchlorethylene from articles of the same assortment with the mass of 9 kg containing, after their centrifugal squeezing, 38% by mass of said solvent by the prior art process described in the Express information referred to, an incomplete removal of perchlorethylene from the articles is observed which results which results in an impaired quality of the articles, increased losses of the solvent up to 30 g per kg of the articles and in pollution of the environment with toxic perchlorethylene. Furthermore, in the above-mentioned prior art process overdrying of the articles takes place which also affects their quality. In this prior art process the rate of steam consumption for drying of 1 kg of textile articles is 1.5 kg, that of cooling water—20 l, the electric power consumption rate being 0.08 kW.h. For carrying out desorption of perchlorethylene from the absorbent it is necessary to shut down the dry-cleaning machine for 1 hour after 24 process cycles of its operation. This results in a lowered productivity of the machine and complicates its servicing. Furthermore, in the prior art process as the adsorbent activated charcoal is used with the mass of 30 kg which is by 7.5 times higher than the mass of carbon employed in the process according to the present invention, thus making use in the process of a more sophisticated equipment.

In recuperation of perchlorethylene from articles of the same assortment with the mass of 9 kg containing after their centrifugal squeezing 38% by mass of the above-mentioned solvent by the above-described prior art process disclosed in U.S. Pat. No. 3,807,948 there is observed an incomplete removal of perchlorethlene from the articles thus impairing their quality, causing increased losses of the solvent up to 12 g per kg of the articles and pollution of the environment with the toxic solvent. Furthermore, in the above mentioned prior art process overdrying of articles takes place which also impairs their quality. In this prior art process the duration of recuperation is 24 minutes, electric power consumption rate is 0.19 kW.h.

EXAMPLE 2

In a manner similar to that described in Example 1 recuperation of perchlorethylene is effected after treatmeent, therewith, in the cleaning drum of a dry-cleaning machine of textile articles from synthetic fabrics (jackets, sweaters, dresses, costumes and the like) with the mass of 9 kg by the procedure suitable for this kind of articles, followed by centrifugal squeezing. The content of perchlorethylene in the treated and squeezed textile articles is 36% by mass, i.e. 3.2 kg.

The duration of air circulation by means of the blower 1 through the cleaning drum 2, filter 3, air cooler 4 and heater 5 is 11 minutes.

Simultaneously with this circulation of air effected first is desorption of perchlorethylene adsorbed in the previous cycle of the dry-cleaning machine operation from the adsorber 9 for 8 minutes, followed by displacement of the steam and its condensate remaining after desorption of perchlorethylene from the adsorber 9 into the heater 5 for 3 minutes. The displacement of the steam and its condensate is effected at the account of the steam pressure drop to 0.3 MPa—by means of the air supplied into the adsorber under the pressure 0.6 MPa.

For desorption of perchlorethylene adsorbed in the previous process cycle of the dry-cleaning machine operation steam is fed under the pressure of 0.4 MPa via the line 10 through the valve 11 into the adsorber 9 and it is passed through the adsorbent 12. As the adsorbent use is made of activated carbon with the characteristics specified in the foregoing Example 1. The adsorbent mass is 4 kg.

Air circulated by means of the blower 1 through the cleaning drum 2, filter 3, air cooler 4 and heater 5 is heated in the heater 5 to the temperature of 60° C. by means of the heat evolved upon condensation of steam and vapours of desorbed perchlorethylene.

In the beginning of drying of textile articles the circulated air has at the outlet of the cleaning drum the temperature of 45° C. at which the content of perchlorethylene in the air is 420 g/m$^3$.

The cleaned heated circulated air containing vapours of perchlorethylene is cooled in the air cooler 4 to the temperature of 25° C. at which the content of perchlorethylene in the air is 175 g/m$^3$.

At the moment of discontinuation of the formation of perchlorethylene in the air cooler 4 the content of perchlorethylene in the textile articles is 3% by mass, i.e. 270 g. The total amount of perchlorethylene contained in the textile articles and in the circulated air filling the cleaning drum 2 and casing 25 of the drying-recuperation unit consisting of the filter 3, blower 1, air cooler 4 and heater 5 is 415 g.

The duration of the air circulation by means of the blower 1 through the cleaning drum 2, filter 3, air cooler 4 and adsorber 9 is 4 minutes.

The total duration of the recuperation process is 15 minutes.

The quality of drying of the articles, losses of perchlorethylene, consumption of steam, cooling water and electric power in the recuperation, as well as the duration of the recuperation process are similar to corresponding parameters given in Example 1 hereinbefore.

The above-listed parameters of carrying out the process of recuperation according to the above-discussed Express information and in U.S. Pat. No. 3,807,948 are similar to corresponding parameters shown in Example 1.

EXAMPLE 3

In a manner similar to that described in Example 1 recuperation of trichlorethylene is effected after treatment, therewith, in a cleaning drum of a dry-cleaning machine of production overalls from a cotton fabric and mixed fabrics produced from synthetic fibres with the addition of syntheitc fibres (coveralls, jackets, trousers and the like) with the mass of 15 kg following the procedure corresponding to this particular range of articles, followed by centrifugal squeezing. The content of trichlorethylene in the treated and squeezed textile articles is 40% by mass, i.e. 5.6 kg.

The duration of aid circulation by means of the blower 1 through the cleaning drum 2, filter 3, air cooler 4 and heater 5 is 14 minutes.

Simultaneously with the above-mentioned air circulation first effected is desorption, from the adsorber 9, of trichlorethylene adsorbed in the previous process cycle of the dry-cleaning machine operation for 11 minutes, followed by displacement of the steam and its condensate remaining after desorption of trichlorethylene from the adsorber 9 to the heater 5 for 3 minutes. The displacement of the steam and its condensate is effected first at the account of the pressure drop in the system adsorber-heater and then, after reducing pressure of the steam in the adsorber to 0.05 MPa—by means of the air supplied into the adsorber under the pressure of 0.03 MPa.

For desorption of trichlorethylene adsorbed in the previous process cycle of the dry-cleaning machine operation steam is admitted under the pressure of 0.3 MPa via the line 10 through the valve 11 into the adsorber 9 and passed through the adsorber 12. As the adsorbent use is made of the same activated carbon as in Example 1 hereinbefore. The mass of the adsorbent is 7 kg.

The air circulated by means of the blower 1 through the cleaning drum 2, filter 3, air cooler 4 and heater 5 is heated in the heater 5 to the temperature of 70° C. by the heat evolved upon condensation of the steam and vapours of desorbed trichlorethylene.

In the beginning of the drying of the articles the circulated air has at the outlet of the cleaning drum 2 the temperature of 45° C. at which the content of trichlorethylene in the air is 1,100 g/m$^3$.

The cleaned heated circulated air containing vapours of trichlorethylene is cooled in the air cooler 4 to the temperature of 25° C. at which the content of trichlorethylene in the air is 550 g/m$^3$.

At the moment when the formation of a condensate of trichlorethylene in the air cooler 4 is stopped the content of trichlorethylene in the textile articles is 3% by mass, i.e. 450 g. The total amount of trichlorethylene contained in the textile articles, as well as in the circulated air filling the cleaning drum 2 and casing 25 of the drying-recuperation unit consisting of the filter 3, blower 1, air cooler 4 and heater 5 is 800 g.

The duration of the air circulation by means of the blower 1 through the cleaning drum 2, filter 3, air cooler 4 and adsorber 9 is 4 minutes.

The total duration of the process of recuperation is 18 minutes.

The quality of drying of articles, losses of trichlorethylene, rates of consumption of steam, cooling water and electric power for recuperation, as well as productivity of the recuperation process are similar to respective characteristics specified in Example 1 hereinbefore.

The above-listed characteristics of the recuperation process performed by the known procedure of the Express information referred to are similar to corresponding characteristics described in Example 1. The amount of activated carbon in the adsorber (at the above-specified load of textile articles into the cleaning drum of the dry-cleaning machine and the indicated periodicity of shutdowns of the machine for carrying out the desorption) is 50 kg which complicates the equipment employed in the process.

In carrying out recuperation by the prior art process as taught in U.S. Pat. No. 3,807,948 the solvent losses are 12 g per kg of the articles which impairs their quality and results in pollution of the environment. Furthermore, in the above-discussed prior art process overdying of articles takes place which also detrimentally affects their quality. In the discussed prior art process the duration of recuperation is 26 minutes, electric power consumption is 0.22 kW.h.

EXAMPLE 4

In a manner similar to that described in Example 1 recuperated in perchlorethylene employed for the treatment, in the cleaning drum 2 of a dry-cleaning machine, of textile woolen articles (costumes, dresses, overcoats, jackets and the like) with the mass of 18 kg following the procedure suitable for this particular assortment of articles, followed by centrifugal squeezing. The content of perchlorethylene in the treated and squeezed textile articles is 38% by mass, i.e. 6.8 kg.

The duration of the air circulation by means of the blower 1 through the cleaning drum 2, filter 3, air cooler 4 and heater 5 is 11 minutes.

Simultaneously with this circulation of air effected first is desorption, from the adsorber 9, of perchlorethylene adsorbed in the previous process cycle of the dry-cleaning machine operation for 8 minutes, followed by displacement of the steam and its condensate remaining after desorption of perchlorethylene from the adsorber 9 into the heater 5 for 3 minutes. The displacement of the steam and its condensate is effected first at the account of the pressure drop in the system adsorber-heater and then, after reducing the steam pressure in the adsorber to 0.3 MPa—by means of the air admitted in the adsorber under the pressure of 0.6 MPa.

For desorption of perchlorethylene adsorbed in the previous process cycle of the dry-cleaning machine steam is fed under the pressure of 0.6 MPa via the line 10 through the valve 11 into the adsorber 9 and passed through the adsorbent 12. As the adsorbent use is made of the same activated carbon as in Example 1 hereinbefore. The adsorbent mass is 7 kg.

Air circulated by means of the blower 1 through the cleaning drum 2, filter 3, air cooler 4 and heater 5 is heated in the heater 5 to the temperature of 90° C. by means of the heat evolved in condensation of steam and vapours of desorbed perchlorethylene.

In the beginning of the process of drying of the articles the circulated air has at the outlet of the cleaning drum the temperature of 50° C. at which the content of perchlorethylene in the air is 520 g/m$^3$.

The cleaned heated circulated air containing perchlorethylene vapours is cooled in the air cooler 4 to the temperature of 25° C. at which the content of perchlorethylene in the air is 175 g/m$^3$.

At the moment when the formation of a condensate of perchlorethylene in the air cooler 4 is stopped, the content of perchlorethylene in the textile articles is 3% by mass or 540 g. The total amount of perchlorethylene contained in the textile articles, as well as in the circulated air filling the cleaning drum 2 and casing 25 of the drying-recuperation unit consisting of the filter 3, blower 1, air cooler 4 and heater 5 is 620 g.

The duration of air circulation by means of the blower 1 through the cleaning drum 2, filter 3, air cooler 4 and adsorber 9 is 4 minutes.

The total duration of the recuperation process is 15 minutes.

The quality of drying of the articles, losses of perchlorethylene, rates of consumption of steam, cooling water and electric power in the recuperation, as well as the duraction of the recuperation process are similar to the respective parameters described in Example 1 hereinbefore.

The above-listed characteristics of the recuperation carried out by the known process disclosed in the Express information referred to are similar to corresponding characteristics shown in Example 1. However, in this case the amount of activated carbon in the adsorber (at the specified load of textile articles into the cleaning drum of the dry-cleaning machine and indicated schedule of shutdowns of the machine for desorption) is 50 kg which complicates the equipment employed in the process.

In carrying out recuperation by the process disclosed in U.S. Pat. No. 3,807,948 the solvent losses, rates of consumption of electric power and duration of the recuperation process are the same as those mentioned in Example 3.

EXAMPLE 5

In a manner similar to that described in Example 1 recuperation of perchorethlene is carried out after its use in the cleaning drum 2 of a dry-cleaning machine containing textile woolen articles (costumes, dresses, overcoats, jackets and the like) with the mass of 30 kg following the procedure corresponding to the given assortment of articles, followed by centrifugal squeezing. The content of perchlorethylene in the thus-treated and squeezed textile articles is 38% by mass of 11.4 kg.

The duration of air circulation by means of the blower 1 through the cleaning drum 2, filter 3, air cooler 4 and heater 5 is 12 minutes.

Simultaneously with said air circulation first effected is desorption of perchlorethylene adsorbed in the previous process cycle of the dry-cleaning machine operation from the desorber 9 for 9 minutes, followed by displacement of the steam and its condensate remaining after desorption of perchlorethylene from the adsorber 9 to the heater 5 for 3 minutes. The displacement of the steam and the condensate thereof is effected at first owing to the pressure drop in the system adsorber-heater and then, after reducing the steam pressure in the adsorber to 0.3 MPa,—by means of air supplied into the adsorber under the pressure of 0.5 MPa.

For desorption of perchlorethylene adsorbed in the previous process cycle of the dry-cleaning machine operation steam is fed under the pressure of 0.6 MPa via the line 10 through the valve 11 into the adsorber 9 and is passed through the adsorbent 12. As the adsorbent the same activated carbon is used as that described in Example 1. The mass of the adsorbent is 12 kg.

The air circulated by means of the blower 1 through the cleaning drum 2, filter 3, air cooler 4 and heater 5 is heated in the heater 5 to the temperature of 90° C. at the account of the heat evolved during condensation of steam and vapours of desorbed perchlorethylene.

At the beginning of the process of drying of the articles the circulated air at the outlet of the cleaning drum has temperature of 50° C. at which the content of perchlorethylene in the air is 520 g/m$^3$.

The cleaned heated circulated air containing vapours of perchlorethylene is cooled in the air cooler 4 to the temperature of 25° C. at which the content of perchlorethlene in the air is 175 g/m$^3$.

At the moment when the formation of a condensate of perchlorethylene in the air cooler 4 is stopped the content of perchlorethylene in the textile articles is 4% by mass, i.e. 1.2 kg. The total amount of perchlorethylene contained in the textile articles, as well as in the circulated air filling the cleaning drum 2 and the casing 25 of the drying-recuperation unit consisting of the filter 3, blower 1, air cooler 4 and heater 5 is 1.5 kg.

The duration of air circulation by means of the blower 1 through the cleaning drum 2, filter 3, air cooler 4 and adsorber 9 is 4 minutes.

The total duration of the recuperation process is 16 minutes.

The quality of drying of the articles, losses of perchlorethylene, rates of consumption of steam, cooling water and electric power for the recuperation, as well as the recuperation process duration are similar to the respective parameters described in Example 1 hereinbefore.

In carrying out recuperation of perchlorethylene from articles of the same assortment with the mass of 30 kg containing, after centrifugal squeezing thereof, 38% by mass of the above-mentioned solvent by the above-mentioned prior art process disclosed in the Express information referred to an incomplete removal of perchlorethylene from the articles is observed which results in an impaired quality of the articles, increased losses of the solvent to 40 g per kg of the articles and in pollution of the environment with the solvent. Furthermore, in this prior art process overdrying of the articles takes place which also provides a detrimental effect on their quality. In this prior art process the rates of consumption of steam, cooling water and electric power, as well as the schedule of shutdown of the dry-cleaning machines for desorption are the same as in Example 1 hereinbefore. Furthermore, at the above-indicated load of textile articles into the cleaning drum of the dry-cleaning machine for desorption in this prior art process the mass of activated carbon in the adsorber is 80 kg thus substantially complicating the equipment employed in the process.

In carrying out recuperation of perchlorethylene from articles of the same assortment with the mass of 30 kg containing, after their centrifugal squeezing, 38% by mass of the above-mentioned solvent by the process disclosed in U.S. Pat. No. 3,807,948 an incomplete removal of perchlorethylene from the textile articles is observed which results in an impaired quality of the articles, increased losses of the solvent to 16 g per kg of the articles and in pollution of the environment with this toxic solvent. Furthermore, in this prior art process overdrying of the articles takes place which also provides a detrimental effect on their quality. In this prior art process the duration of the recuperation process is 28 minutes, the rate of electric power consumption is 0.30 kW h.

EXAMPLE 6

In a manner similar to that described in Example 1 hereinbefore, recuperation is carried out of perchlorethylene used to treat, in the cleaning drum 2 of a dry-cleaning machine, fur and suede articles (leather and fur jackets and the like) with the mass of 20 kg following the procedure corresponding to this particular assortment of articles with a subsequent squeezing by centrifugation. The content of perchlorethylene in the treated and squeezed articles is 46% by mass, i.e. 11.2 kg.

The duration of air circulation by means of the blower 1 through the cleaning drum 2, filter 3, air cooler 4 and heater 5 is 28 minutes.

Simulateously with the above-mentioned air circulation first effected is desorption of perchlorethylene adsorbed in the previous process cycle of the dry-cleaning machine operation from the desorber 9 for 25 minutes, followed by displacement of the steam and its condensate remaining after desorption of perchlorethylene from the adsorber 9 to the heater 5 for 3 minutes. The displacement of steam and its condensate is effected first at the account of the pressure drop in the system adsorber-heater and then, after reducing the steam pressure in the adsorber to 0.3 MPa,—by means of air supplied into the adsorber under the pressure of 0.6 MPa.

For desorption of perchlorethylene adsorber in the previous process cycle of the dry-cleaning machine operation steam is fed under the pressure of 0.5 MPa via the line 10 through the valve 11 into the adsorber 9 and passed through the adsorber 12. As the adsorbent the same activated arbon is used as in Example 1. The mass of the adsorbent is 12 kg.

The air circulated by means of the blower 1 through the cleaning drum 2, filter 3, air cooler 4 and heater 5 is heated in the heater 5 to the temperature of 60° C. owing to the heat evolved upon condensation of the steam and vapours of desorbed perchlorethylene.

At the beginning of drying of the articles the temperature of the circulated air at the outlet of the cleaning drum 2 is 45° C. at which the content of perchlorethylene in the air is 420 g/m$^3$.

The cleaned heated circulating air containing vapours of perchlorethylene is cooled in the air cooler 4 to the temperature of 25° C. at which the content of perchorethylene in the air is 175 g/m$^3$.

At the moment when the formation of a condensate of perchlorethylene in the air cooler 4 is stopped the content of perchlorethylene in the textile articles is 6% by mass, i.e. 1.2 kg. The total amount of perchlorethylene contained in textile articles, as well as in the circulated air filling the cleaning drum 2 and casing 25 of the drying-recuperation unit consisting of the filter 2, blower 1, air-cooler 4 and heater 5 is 1.4 kg.

The duration of air circulation by means of the blower 1 through the cleaning drum 2, filter 3, air cooler 4 and adsorber 9 is 12 minutes.

As a result, a high quality of drying of the textile articles is ensured (a substantially complete removal of perchlorethylene therefrom with preservation of their natural wetness), losses of perchlorethylene are considerably reduced, pollution of the environment with perchlorethylene is prevented. In recuperation of perchlorethylene by the process according to the present invention the loss of the solvent is 10 g per kg of the articles (mainly due to an incomplete separation of water from perchlorethylene in the settling-type water separator).

For drying of textile articles with substantially full recuperation of perchlorethylele 1.2 kg of steam 20 l of cooling water are consumed; the rate of electric power consumption is 0.07 kW.h.

In recuperation of perchlorethylene from articles of the same assortment with the mass of 20 kg containing, after their centrifugal squeezing, 46% by mass of the above-mentioned solvent by the above-discussed known process disclosed in U.S. Pat. No. 3,807,948 an incomplete removal of perchlorethylene from the articles takes place which results in an impaired quality thereof, increased losses of the solvent up to 30 g per kg of the articles and in pollution of the environment with this toxic solvent. In this prior art process the duration of recuperation is 66 minutes, the rate of electric power consumption is 0.35 kW h.

EXAMPLE 7

In a manner similar to that described in Example 1 recuperation of perchlorethylene is effected which has been used for the treatment, in the cleaning drum 2 of a dry-cleaning machine, of woolen textile articles (costumes, dresses, overcoats, jackets and the like) with the mass of 50 kg by the procedure suitable for this particular assortment of articles, followed by their centrifugal squeezing. The content of perchlorethylene in the treated and squeezed textile articles is 40% by mass, i. i.e. 20 kg.

The duration of air circulation by means of the blower 1 through the cleaning drum 2, filter 3, air cooler 4 and heater 5 is 12 minutes.

Simultaneously with this circulation of air effected first is desorption of perchlorethylene adsorbed in the previous process cycle of the dry-cleaning machine from the adsorber 9 for 9 minutes, followed by displacement of the steam and its condensate remaining after desorption of perchlorethylene from the adsorber 9 into the heater 5 for 3 minutes. The displacement of the steam and its condensate is effected first at the account of the pressure drop in the system adsorber-heater and then, after reducing the steam pressure in the adsorber to 0.3 MPa,—by means of the air admitted into the adsorber under the pressure of 0.6 MPa.

For desorption of perchlorethylene adsorbed in the previous process cycle of the dry-cleaning machine operation steam is supplied under the pressure of 0.6 MPa via the line 10 through the valve 11 into the adsorber 9 and passed through the adsorbent 12. As the adsorbent the same activated carbon as in Example 1 is used. The mass of the adsorbent is 20 kg.

The air circulated by means of the blower 1 through the cleaning drum 2, filter 3, air cooler 4 and heater 5 is heated in the heater 5 to the temperature of 80° C. by the heat evolved during condensation of the steam and vapours of desorbed perchlorethylene.

At the beginning of drying of the articles the circulated air at the outlet of the cleaning drum 2 has temperature of 50° C. at which the content of perchlorethylene in the air is 520 g/m$^3$.

The cleaned heated circulating air containing vapours or perchlorethylene is cooled in the air cooler 4 to the temperature of 25° C. at which the content of perchlorethylene in the air is 175 g/m$^3$.

At the moment of the formation of a condensate of perchlorethylene in the air cooler 4 is stopped the content of perchlorethylene in the textile articles is 4% by mass, i.e. 2 kg. The total amount of perchlorethylene contained in the textile articles, as well as in the circulated air filling the cleaning drum 2 and casing 25 of the drying-recuperation unit consisting of the filter 3, blower 1, air cooler 4 and heater 5 is 2.4 kg.

The duration of air circulation by means of the blower 1 through the cleaning drum 2, filter 3, air cooler 4 and adsorber 9 is 5 minutes.

The total duration of the recuperation process is 17 minutes.

The quality of drying of textile articles, losses of perchlorethylene, rates of consumption of steam, cooling water and electric power for the recuperation, as well as the recuperation process duration are similar to corresponding parameters described in Example 1 hereinbefore.

EXAMPLE 8

In a manner similar to that described in Example 1 recuperation of trichlorethylene is effected which has been used for the treatment, in the cleaning drum of a dry-cleaning machine, of production overalls made from a cotton fabric and a man-made quilted fur (quilted jackets, trousers and the like) with the mass of 50 kg by the procedure corresponding to this particular assortment of articles, followed by centrifugal squeezing. The content of trichlorethylene in the treated and squeezed textile articles is 40% by mass, i.e. 20 kg.

The duration of air circulation by means of the blower 1 through the cleaning drum 2, filter 3, air cooler 4 and heater 5 is 15 minutes.

Simultaneously with this circulation of air also effected first is desorption of trichlorethylene adsorbed in the previous process cycle of the dry-cleaning machine operation from the desorber 9 for 12 minutes, then—displacement of the steam and its condensate remaining after desorption of trichlorethylene from the adsorber 9 to the heater 5 for 3 minutes. The displacement of the steam and its condensate is effected at first owing to the pressure drop in the system adsorber-heater and then, after reducing the steam pressure in the adsorber to 0.2 MPa,—by means of air supplied into the adsorber under the pressure of 0.5 MPa.

For desorption of trichlorethylene adsorbed in the previous process cycle of the dry-cleaning machine operation steam is admitted under the pressure of 0.4 MPa via the line 10 through the valve 11 into the adsorber 9 and passed through the adsorbent 12. As the adsorbent the same activated carbon as in Example 1 is used. The mass of the adsorbent is 20 kg.

The air circulated by means of the blower 1 through the cleaning drum 2, filter 3, air cooler 4 and heater 5 is heated in the heater 5 to the temperature of 70° C. by the heat evolved in condensation of the steam and vapours of desorbed trichlorethylene.

At the beginning of drying of the textile articles the temperature of the circulated air at the outlet of the cleaning drum 2 is 45° C. at which the content of trichlorethylene in the air is 1,100 g/m$^3$.

The cleaned heated circulated air containing trichlorethylene vapours is cooled in the air cooler 4 to the temperature of 25° C. at which the content of trichlorethylene in the air is 550 g/m$^3$.

At the moment when the formation of a condensate of trichlorethylene is stopped in the air cooler 4 the content of trichlorethylene in the textile articles is 4% by mass, i.e. 2 kg. The total content of trichlorethylene in the textile articles and in the circulated air filling the cleaning drum 2 and casing 25 of the drying-recuperation unit consisting of the filter 3, blower 1, air cooler 4 and heater 5 is 2.6 kg.

The duration of air circulation by means of the blower 1 through the cleaning drum 2, filter 3, air cooler 4 and adsorber 9 in 5 minutes.

The total duration of the recuperation process is 20 minutes.

The quality of drying of the articles, losses of the solvent, rates of consumption of steam, cooling water and electric power, as well as the recuperation process duration are similar to the respective parameters described in Example 1 hereinbefore.

EXAMPLE 9

In a manner similar to that described in Example 1 perchlorethylene recuperation is effected; the solvent has been used for the treatment, in the cleaning drum 2 of a dry-cleaning machine, of textile woolen articles (costumes, dresses, overcoats, jackets and the like) with the mass of 100 kg by the procedure appropriate for this particular assortment of articles, followed by centrifugal squeezing. The content of perchlorethylene in the treated and squeezed textile articles is 40% by mass, i.e. 40 kg.

The duration of air circulation by means of the blower 1 through the cleaning drum 2, filter 3, air cooler 4 and heater 5 is 15 minutes.

Simultaneously with this circulation of air effected also is, at first, desorption of perchlorethylene adsorbed in the previous process cycle of the dry-cleaning machine operation from the adsorber 9 for 12 minutes, then—displacement of the steam and its condensate remaining after desorption of perchlorethylene from the adsorber 9 to the heater 5 for 3 minutes. The displacement of the steam and its condensate is effected first due to the pressure drop in the system adsorber-heater and then, after reducing the steam pressure in the adsorber to 0.3 MPa,—by means of air supplied into the adsorber under the pressure of 0.6 MPa.

For desorption of perchlorethylene adsorbed in the previous process cycle of dry-cleaning machine operation the steam is admitted under the pressure 0.6 MPa via the line 10 through the valve 11 into the adsorber 9 and passed through the adsorbent 12. As the adsorbent the same activated carbon as in Example 1 is used. The mass of the adsorbent is 30 kg.

The air circulated by means of the blower 1 through the cleaning drum 2, filter 3, air cooler 4 and heater 5 is heated in the heater 5 to the temperature of 90° C. by the heat evolved during condensation of steam and vapours of desorbed perchlorethylene.

At the beginning of drying of the textile articles the temperature of the circulated air at the outlet of the cleaning drum 2 is 50° C. at which the content of perchlorethylene in the air is 520 g/m$^3$.

The cleaned heated circulated air containing perchlorethylene vapours is cooled in the air cooler 4 to the temperature of 25° C. at which the content of perchlorethylene in the air is 175 g/m$^3$.

At the moment when the formation of a condensate of perchlorethylene in the air cooler 4 is stopped the content of perchlorethylene in the textile articles is 3% by mass, i.e. 3 kg. The total amount of perchloethylene contained in the textile articles and the circulated air filling the cleaning drum 2 and casing 25 of the drying-recuperation unit consisting of the filter 3, blower 1, air cooler 4 and heater 5 is 3.6 kg.

The duration of air circulation by means of the blower 1 through the cleaning drum 2, filter 3, air cooler 4 and adsorber 9 is 5 minutes.

The total duration of the recuperation process is 20 minutes.

The quality of drying of the articles, losses of perchlorethylene, rates of consumption of steam, cooling water and electric power, as well as the recuperation process duration are similar to the respective parameters described in Example 1 hereinbefore.

EXAMPLE 10

In a manner similar to that described in Example 1 perchlorethylene is recuperated after its use for the treatment, in the cleaning drum 2 of a dry-cleaning machine, of woolen carpet articles (carpets, carpet runners and the like) with the mass of 60 kg by the procedure suitable for this particular assortment of articles, followed by centrifugal squeezing. The content of perchlorethylene in the treated and squeezed textile articles is 47% by mass, i.e. 28 kg.

The duration of air circulation by means of the blower 1 through the cleaning drum 2, filter 3, air cooler 4 and heater 5 is 23 minutes.

Simultaneously with the circulation of air effected is, at first, desorption of perchlorethylene adsorbed in the previous process cycle of the dry-cleaning machine operation from the adsorber 9 for 20 minutes, then—displacement of the steam and its condensate remaining after desorption of perchlorethylene from the adsorber 9 to the heater 5 for 3 minutes. The displacement of the steam and its condensate is effected first at the account of the pressure drop in the system adsorber-heater and then, after reducing the steam pressure in the adsorber to 0.3 MPa,—by means of air supplied to the adsorber under the pressure of 0.6 MPa.

For desorption of perchlorethylene adsorbed in the previous process cycle of the dry-cleaning machine operation steam is admitted under the pressure of 0.7 MPa via the line 10 through the vavle 11 into the adsorber 9 and passed through the adsorbent 12. As the adsorbent use is made of the activated carbon with the characteristics specified in Example 1. The mass of the adsorbent is 30 kg.

The air circulated by means of the blower 1 through the cleaning drum 2, filter 3, air cooler 4 and heater 5 is heated in the heater 5 to the temperature of 95° C. by the heat evolved in condensation of the steam and vapours of desorbed perchlorethylene.

At the beginning of drying of the textile articles the temperature of the circulated air at the outlet of the leaning drum 2 is 55° C. at which the content of perchlorethylene in the air is 620 g/m$^3$.

The cleaned heated circulated air containing perchlorethylene vapours is cooled in the air cooler 4 to the temperature of 25° C. at which the content of perchlorethylene in the air is 175 g/m$^3$.

At the moment where the formation of a condensate of perchlorethylene in the air cooler 4 is stopped the content of perchlorethlene in the textile articles is 5% by mass, i.e. 3 kg. The total amount of perchlorethylene contained in the textile articles and in the circulated air filling the cleaning drum 2 and casing 25 of the drying-recuperation unit consisting of the filter 3, blower 1, air cooler 4 and heater 5 is 3.6 kg.

The duration of air circulation by means of the blower 1 through the cleaning drum 2, filter 3, air cooler 4 and adsorber 9 is 6 minutes.

The total duration of the recuperation process is 29 minutes.

The quality of drying of the articles, losses of perchlorethylene, rates of consumption of steam, cooling water and electric power for the recuperation, as well as the recuperation process duration are similar to the respective parameters described in Example 6 hereinbefore.

Therefore, the process for recuperation of organic solvents in dry-cleaning machines according to the present invention ensures a better quality of drying of textile articles as compared to the prior art processes described in the Express information referred to and in U.S. Pat. No. 3,807,948 due to a substantially complete removal of the organic solvents from the articles while retaining their natural wetness; it also makes possible to substantially reduce losses of organic solvents (by nearly 10 times as compared to the prior art process as taught in the above-mentioned Express information and by 4–5 times as compared to the prior art process of U.S. Pat. No. 3,807,948), to prevent pollution of the environment with said solvents, to lower the rates of consumption of steam and cooling water (by about 2 times as compared to the process of said Express information), to lower the rate of electric power consumption (by 3–5 times as compared to the process of U.S. Pat. No. 3,807,948), to increase productivity of a dry-cleaning machine owing to a shorter duration of the process of recuperation of the solvents (by 1.4–1.6 times as compared to the prior art process according to U.S. Pat. No. 3,807,948) and owing ti elimination of the necessity of periodic shut-down of the dry-cleaning machine for desorption of the adsorbed solvent (as compared to the prior art process disclosed in the Express information referred to).

Furthermore, the process according to the present invention facilitates maintenance of a dry-cleaning machine as compared to the prior art process described in the above-mentioned Express information.

The process according to the present invention can be useful in dry-cleaning machines with different loading mass of articles in contrast to the processes disclosed in the Express information referred to and in U.S. Pat. No. 3,807,948, the use of which processes in dry-cleaning machines with the loading mass of articles of more then 30 kg becomes economically inefficient.

What is claimed is:

1. A process for recovering organic solvents in a dry-cleaning process which comprises the steps of:

(1) circulating air by means of a blower through a cleaning drum of a dry-cleaning machine containing:

(a) textile articles treated with an organic solvent and squeezed;

(b) a filter to remove solid foreign matter from the circulating air stream;

(c) an air cooler to reduce the temperature of the circulating air and condense organic solvent, condensed organic solvent being separated from the circulating air and recovered; and (d) a heater to reheat the circulating air before contact with the textile articles; until the amount of solvent removed by the circulating air, by cooling the air in the air cooler, is substantially reduced, the circulating air being heated in the heater by condensation of a vapor-containing steam, obtained by desorption of organic solvent and steam from an adsorbent in an adsorption zone, by passing steam, at a pressure of from 0.3 to 0.7 MPa, through the adsorbent until the organic solvent has been desorbed;

(2) passing air at a pressure of from 0.3 to 0.6 MPa through the adsrobent to cool the adsorbent and reduce the amount of water adsorbed on the adsorbent;

(3) recovering the condensed organic solvent from the heater; and (4) circulating the air by means of the blower through the cleaning drum containing the textile articles, the filter, the air cooler, the adsorbent in the adsorbtion zone to remove the organic solvent from the cold air and heater, which is not heated, to recover the organic solvent from the textiles.

* * * * *